US006807896B2

(12) United States Patent
Inoue

(10) Patent No.: US 6,807,896 B2
(45) Date of Patent: Oct. 26, 2004

(54) HIGH PRESSURE SUPPLY PUMP WITH LIFTER GUIDE AND METHOD OF MANUFACTURING THE LIFTER GUIDE

(75) Inventor: Hiroshi Inoue, Anjo (JP)

(73) Assignee: Denso Corporation, Kariya (JP)

( * ) Notice: Subject to any disclaimer, the term of this patent is extended or adjusted under 35 U.S.C. 154(b) by 77 days.

(21) Appl. No.: 10/386,559

(22) Filed: Mar. 13, 2003

(65) Prior Publication Data

US 2003/0175137 A1 Sep. 18, 2003

(30) Foreign Application Priority Data

Mar. 15, 2002 (JP) ..... 2002-072690

(51) Int. Cl.[7] ..... F02M 59/00
(52) U.S. Cl. ..... 92/165 R
(58) Field of Search ..... 92/165 R, 169.4, 92/171.1

(56) References Cited

U.S. PATENT DOCUMENTS 5,567,134 A * 10/1996 Inoue ..... 417/490
5,752,430 A 5/1998 Kawajiri et al. ..... 92/130 R

FOREIGN PATENT DOCUMENTS

JP 10-141178 5/1998

* cited by examiner

*Primary Examiner*—Thomas E. Lazo
(74) *Attorney, Agent, or Firm*—Nixon & Vanderhye P.C.

(57) ABSTRACT

In a lifter guide of a high pressure supply pump, a flat plate, whose periphery line is provided with a projection and whose the other periphery line circumferentially opposed to the periphery line is provided with a recess, is formed from a metal sheet by stamping. Then, the flat plate is rounded circumferentially so as to cause the periphery line to abut on the other periphery line so that the flat plate is formed in generally cylindrical shape and the projection is fitted to the recess. Subsequently, the periphery line is seamed by staking or welding with the other periphery line to reinforce fitting between the projection and the recess. Thinner wall thickness of the lifter guide can be achieved with a simpler process, compared to that of the conventional lifter guide formed by forging or machining.

14 Claims, 8 Drawing Sheets

HIGH PRESSURE SUPPLY PUMP WITH LIFTER GUIDE AND METHOD OF MANUFACTURING THE LIFTER GUIDE

CROSS REFERENCE TO RELATED APPLICATIONS

This application is based upon and claims the benefit of priority of Japanese Patent Application No. 2002–72690 filed on Mar. 15, 2002, the content of which is incorporated herein by reference.

BACKGROUND OF THE INVENTION

1. Field of the Invention

The present invention relates to a high pressure supply pump with a lifter guide for supplying fuel to an internal combustion engine (hereinafter called "engine") and a method of manufacturing the lifter guide.

2. Description of Related Art

A high pressure fuel pump having a cylindrical tappet guide (lifter guide) for guiding a tappet (lifter) is known. The tappet guide disclosed in JP-A-10-141178 is formed separately from a housing and connected thereto. Since an area of an engine head in which the high pressure fuel pump is installed is limited and a larger outer diameter of the tappet is required, it is preferable that wall thickness of the tappet guide is as thin as possible. Axial length of the tappet guide is relatively long to accommodate a spring urging a plunger toward the tappet. Further, the tappet guide is provided at a circumferential wall thereof with an opening through which air, fuel or oil is sucked into or ejected out of an interior thereof when the tappet reciprocatingly moves along an interior wall of the tappet guide. In case of a cylindrical member, such as the tappet guide mentioned above, having thin wall thickness and relatively high dimensional and shape accuracy, it is common that rough shape of the cylindrical member is formed at first, typically, by drawing or cold forging and, then, final shape of the cylindrical member is formed, typically, by machining inner diameter thereof to secure demanded dimensional and shape accuracy.

However, on machining the tappet guide, the tappet guide is clamped to a process machine. The dimensional and shape accuracy of the tappet guide is generally assured in a state that the tappet guide is clamped to the process machine. Since clamping force applied to the tappet guide attached to the process machine during machining is not applied to the tappet guide detached from the process machine after machining, shape of the tappet guide attached to the process machine during machining is prone to differ from that detached from the process machine after machining, unless the circumferential wall of the tappet guide has adequate stiffness. To secure the adequate stiffness of the circumferential wall of the tappet guide, very thin wall thickness of the tappet guide can not be realized. Further, the opening of the tappet guide is formed by drilling so that, after having formed the opening, it is required to have a process of removing burrs at a circumferential periphery of the opening, which results in increasing manufacturing cost.

On the other hand, in case of a high pressure supply pump disclosed in JP-A-10-30525, a tappet guide is formed integrally with a housing. For machining the tappet guide, a portion of the housing except the tappet guide can be clamped to the process machine so that the clamping force is not directly applied to the tappet guide. Accordingly, shape of the tappet guide in a state that the housing is attached to the process machine does not differ from that in a state that the housing is detached from the process machine. This makes it possible to form the tappet guide having thinner wall thickness.

However, since the tappet guide formed integrally with the housing, typically, by forging is roughly shaped, a relatively large amount of the wall thickness of the tappet guide has to be removed by machining so as to form the tappet guide having thinner wall thickness with higher dimensional and shape accuracy, which results in more fabrication time and higher manufacturing cost. Further, the drilling process of forming the opening of the tappet guide becomes necessary so that more fabrication time is required.

SUMMARY OF THE INVENTION

An object of the present invention is to provide a compact high pressure supply pump having larger discharge amount and higher discharge pressure and incorporating a lifter guide whose wall thickness is thinner and which is easily formed with less fabrication time.

Another object of the present invention is to provide a method of manufacturing a lifter guide whose wall thickness is thinner and which is easily formed with less fabrication time.

To achieve the above object, in the high pressure supply pump in which a drive force of a drive cam is transmitted via a lifter to a plunger slidably and reciprocatingly movable in a cylinder of a housing, a lifter guide is positioned around a circumferential wall of the lifter and fixed to the housing concentrically with the plunger so as to guide the lifter to move reciprocatingly therein. A circumferential wall of the lifter guide has a seam bridging at least a part of a gap extending from an axial end to the other axial end thereto.

The lifter guide mentioned above can be easily manufactured, for example, by rounding a flat plate in cylindrical shape and seaming opposite circumferential ends. This means that thinner wall thickness of the lifter guide can be secured through a relatively simple fabrication process, compared to the conventional lifter guide formed by machining or forging and machining. The thinner wall thickness of the lifter guide causes the lifter to have larger outer diameter so that an area of the lifter in contact with a cam surface of the drive cam is larger. This makes it possible to have wider width of the cam surface of the drive cam and to have larger lift amount of the drive cam. Accordingly, discharge amount and discharge pressure of the high pressure supply pump are larger, compared to those of the conventional high pressure supply pump whose body size is equal to that of the high pressure supply pump. In other words, body size of the high pressure supply pump is more compact, compared to that of the conventional high pressure pump whose discharge amount and discharge pressure are equal to those of the high pressure supply pump.

It is preferable that the gap is not entirely seamed so that a part of the gap constitutes an opening. When the lifter moves recirocatingly in the lifter guide, air, fuel or oil in an interior of the lifter guide can flow through the opening from the interior to an exterior of the lifter guide or from the exterior to the interior thereof so that the air, fuel or oil does not affect as drive resistance against the lifter.

Further, it is preferable that the lifter guide unfolded circumferentially by cutting off the seam is provided at a circumferential end thereof with a projection and at another circumferential end thereof with a recess to be fitted to the projection. This construction serves to easily fabricate the lifter guide, since, when the flat plate is rounded cylindrically, the projection is easily fitted to the recess.

Preferably, a circumferential height of the projection is shorter than a circumferential depth of the recess so that an opening is formed between a top of the projection and a bottom of the recess when the projection is fitted to the recess. The opening, through which air, fuel or oil passes, can be easily formed.

Furthermore, it is preferable that the circumferential wall of the lifter guide has another opening circumferentially apart from the opening. In a case of a high speed and high revolution engine in which the lifter moves at high speed, the air, fuel or oil can be smoothly sucked and ejected not only through the opening but also through the another opening.

Moreover, preferably, thickness of the circumferential wall of the lifter guide is not thinner than 0.5 mm but not thicker than 2.0 mm. The conventional lifter guide formed by machining needs over 2.0 mm wall thickness to secure stiffness with which the lifter guide is not substantially deformed after being detached from a process machine. On the other hand, the lifter guide whose wall thickness is not thicker than 2.0 mm can be easily fabricated by rounding a flat plate in cylindrical form. However, the lifter guide whose wall thickness is thinner than 0.5 mm is short of strength demanded for the lifter guide itself.

Still further, it is preferable that the seam and the gap are positioned on a diametrical line of the lifter guide whose direction crosses a cam surface center line of the drive cam at a given angle thereto, preferably, perpendicularly thereto. Since the lifter is inclined in the interior in the lifter guide in a direction of a cam surface center line of the drive cam, the lifter never contacts the seam and the gap positioned on a diametrical line of the lifter guide whose direction crosses the cam surface center line of the drive cam.

A method of manufacturing the lifter guide is comprised of steps of forming a flat plate whose periphery line is provided with a projection and whose another periphery line circumferentially opposed to the periphery line is provided with a recess, then, rounding the flat plate circumferentially so as to cause the periphery line to abut on the another periphery line so that the flat plate is formed in generally cylindrical shape and the projection is fitted to the recess, and seaming al least partly the periphery line with the another periphery line to reinforce fitting between the projection and the recess.

According to the method mentioned above, thinner wall thickness of the lifter guide can be achieved with a simpler process, compared to that of the conventional lifter guide formed by forging or machining.

It is preferable to adjust inner diameter of the flat plate formed in cylindrical shape to predetermined shape and dimension when the flat plate is rounded, for example, by inserting a forming tool whose diameter is a given value into the flat plate formed in cylindrical shape and, then, pressing inward the flat plate formed in cylindrical shape from an exterior thereof. This process serves to secure higher shape accuracy of the inner diameter of the lifter guide.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

DETAILED DESCRIPTION OF THE PREFERRED EMBODIMENTS

Embodiments of the present invention are described with reference to figures.

(First Embodiment)

Figure 1:
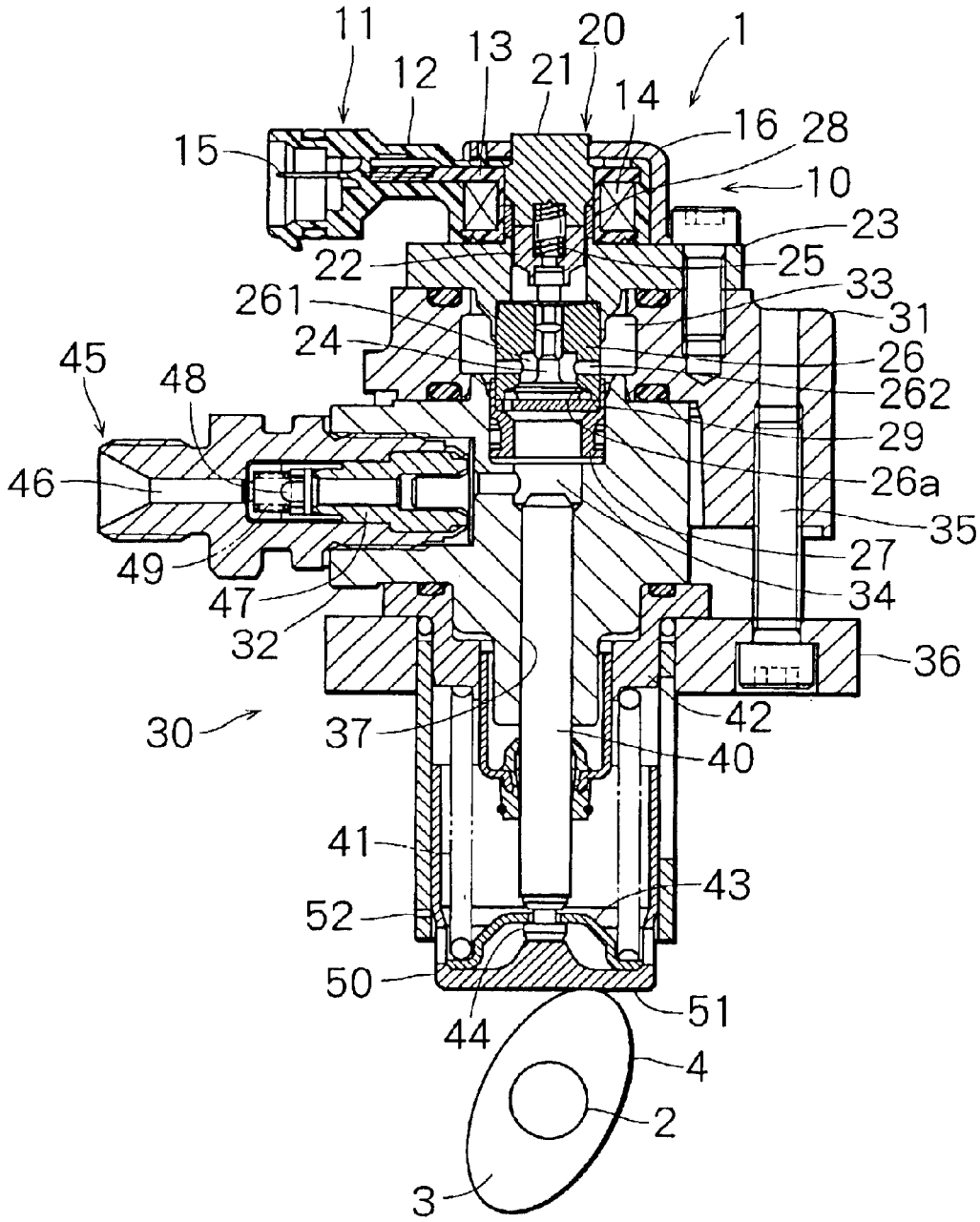
FIG. 1 is a schematic cross sectional view of a high pressure supply pump having a lifter guide according to a first embodiment of the present invention.

FIG. 1 shows a high pressure supply pump with a lifter guide according to a first embodiment of the present invention. A high pressure supply pump 1, whose discharge amount of high pressure fuel is controlled by opening and closing an electromagnetic valve 10, supplies fuel to, for example, a diesel or gasoline engine. The high pressure supply pump 1 has the electromagnetic valve 10 and a pump mechanism 30 that intakes, compresses and discharges fuel.

The electromagnetic valve 10 has a coil member 11 and a valve member 20. The coil member 11, whose angular position is defined by a pin (not shown), is arranged outside the valve member 20. The coil member 11 serves as an electromagnetic drive unit for rendering a drive force to the valve member 20. A connector 12 is made of mold resin so as to cover a bobbin 13 and a coil 14 wound on the bobbin 13. A terminal 15 is electrically connected with the coil 14. A metal cover 16 is connected with a fixed core 21 and a valve housing 23 for constituting a magnetic circuit.

The valve member 20 is composed of the fixed core 21, a movable core 22, the valve housing 23, a valve 24, a valve spring 25, a valve body 26, a cup 27 and a non-magnetic element 28. The movable core 22 can recirocatingly move in an interior of the valve housing 23. The valve 24 can recirocatingly move together with the movable core 22. The valve body 26 is provided with a valve seat 26 on which the valve 24 can be seated. A stopper 29, with which the valve 24 comes in contact, is arranged on a side of the pump member 30, that is, on a lower side in FIG. 1, with respect to the valve 24. The valve spring 25 urges the movable core 22 and the valve 24 toward the valve seat 26*a*.

The valve spring 25 urges the movable core 22 in a direction away from the fixed core 21. The fixed core 21 and the movable core 22 constitute a magnetic circuit so that, the movable core 22 is attracted upward in FIG. 1 toward the fixed core 21 against a biasing force of the valve spring 25 by a magnetic attracting force exerted upon energizing the coil 14. The cup 27 and the valve body 26 accommodated in an interior of the cup 27 are housed inside a cover member 31 and a housing main body 32 that constitute a pump housing of the pump member 30.

The valve body 26 is formed in a tubular shape and provided with a communication hole 262 through which a tubular inner passage 261 communicates with a fuel flow-in passage 33 positioned between the valve body 26 and the cover member 31. When the valve 24 comes in contact with the valve seat 26*a* formed on the valve body 26, the inner passage 261 is closed so that communication between the fuel flow-in passage 33 and a pressure chamber 34 is shut off. Low pressure fuel is supplied to the fuel flow-in passage 33 from a low pressure pump (not shown).

The pump housing of the pump member 30 is composed of the cover member 31 and the housing main body 32. The cover member 31 is provided with the fuel flow-in passage 33 and formed separately from the housing main body 32. The cover member 31 is connected to an attachment portion 36 by a plurality of bolts 35. The housing main body is sandwiched and urged by connecting force of the bolts 35 between the cover member 31 and the attachment portion 36.

The housing main body 32 is provided with a cylinder 37 in which a plunger 40 is held to move reciprocatingly. The pressure chamber 34 is formed by an inner wall of the cylinder 37, the cup 27 and the valve 24. A plunger spring 41, whose one end is in contact with a spring seat 42 and whose the other end is in contact with a spring seat 43, urges the spring seat 42 toward a bottom inner wall of a lifter 50 formed in shape of a cylinder with a bottom. The spring seat 43 retains a head 44 of the plunger 40. The spring seat 42 is sandwiched between the attachment portion 36 and the housing main body 32.

A lifter guide 60 for guiding the lifter 50 is arranged around an outer circumference of the lifter 50. The lifter guide 60 is formed in a cylindrical shape and an axial end of the lifter guide 60 is arranged between an inner circumference of the attachment portion 36 and an outer circumference of the spring seat 42, typically, by press fitting. The other axial end of the lifter guide 60 has an opening. A bottom outer wall 51 of the lifter 50 is in contact through the opening of the lifter guide 60 with a drive cam 3 attached to a valve camshaft 2 of the engine. A pin 52 prevents the lifter 50 from falling out of the lift guide 60.

A delivery valve 45 is screw connected with the housing main body 32 and provided with a fuel flow-out passage 46 enable to communicate with the pressure chamber 34. The delivery valve 45 has a valve seat 47, a valve 48 and a spring 49. When fuel pressure of the pressure chamber 34 increases beyond a given value, the valve 48 leaves the valve seat 47 against a biasing force of the spring 49 so that the pressure chamber 34 communicates with the fuel flow-out passage 46 and fuel is press fed to a fuel pipe (not shown) connected to the delivery valve 45. Fuel discharged from the delivery valve 45 is supplied via a pressure accumulation pipe (not shown) to injectors (not shown).

An operation of the high pressure supply pump is described below.

The drive cam 3 is driven according to rotation of the valve camshaft 2 so that the plunger 40 is reciprocatingly moves together with the lifter 50 and the spring seat 43. Upon de-energizing the coil 14 of the electromagnetic valve 10, the plunger 40 is moved from an upper dead point on an upper side in FIG. 1 to a lower dead point on a lower side in FIG. 1 and the valve 24 leaves the valve seat 26*a* due to the biasing force of the valve spring 25 so that the electromagnetic valve 10 is in a valve opening state. As the plunger 40 moves downward in FIG. 1, fuel discharged from the low pressure fuel pump flows into the pressure chamber 34 via the fuel flow-in passage 33, the communication hole 262 and the inner passage 261. When the plunger 40 is at the lower dead point, maximum amount of fuel flows into the pressure chamber 34.

When the plunger reaches a position corresponding to required discharge fuel amount Within a stroke in that the plunger 40 moves from the lower dead point to the upper dead point, the coil 14 is energized by ECU so that the movable core 22 is attracted toward the fixed core 21 and the valve 24 comes in contact with the valve seat 26*a*. At this stage, the electromagnetic valve 10 is in a valve closing state. Subsequently, as the plunger 40 further moves toward the upper dead point, pressure of fuel in the pressure chamber 34 is higher. When the pressure of fuel in the pressure chamber 34 increase beyond a given pressure, the valve 48 leaves the valve seat 47 against the biasing force of the spring 49 so that high pressure fuel of the high pressure chamber 34 is discharged from the fuel flow-out passage 46.

Details of the lifter guide 60 are described below.

Figure 2:
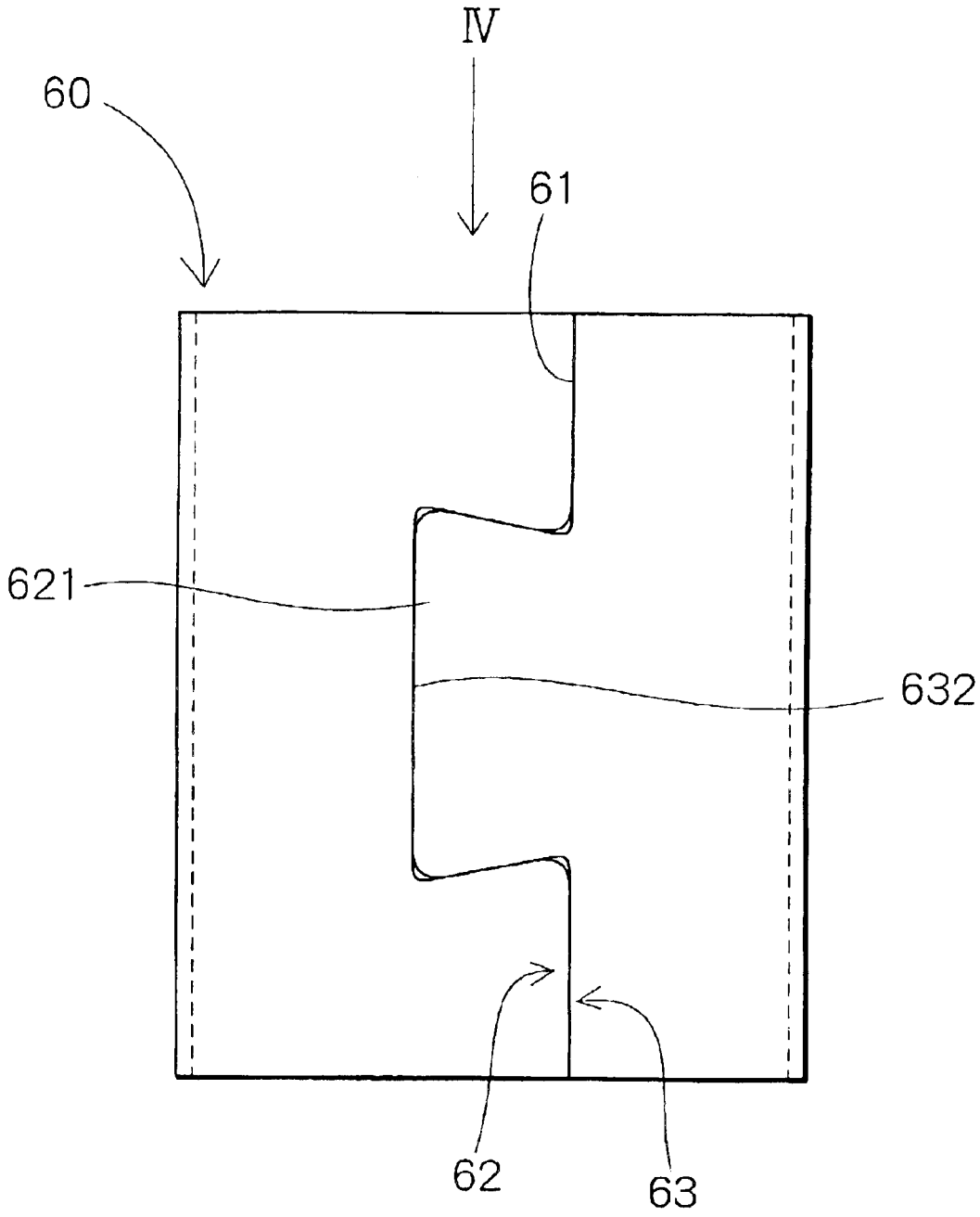
FIG. 2 is a schematic elevation view of the lifter guide of FIG. 1.
Figure 3:
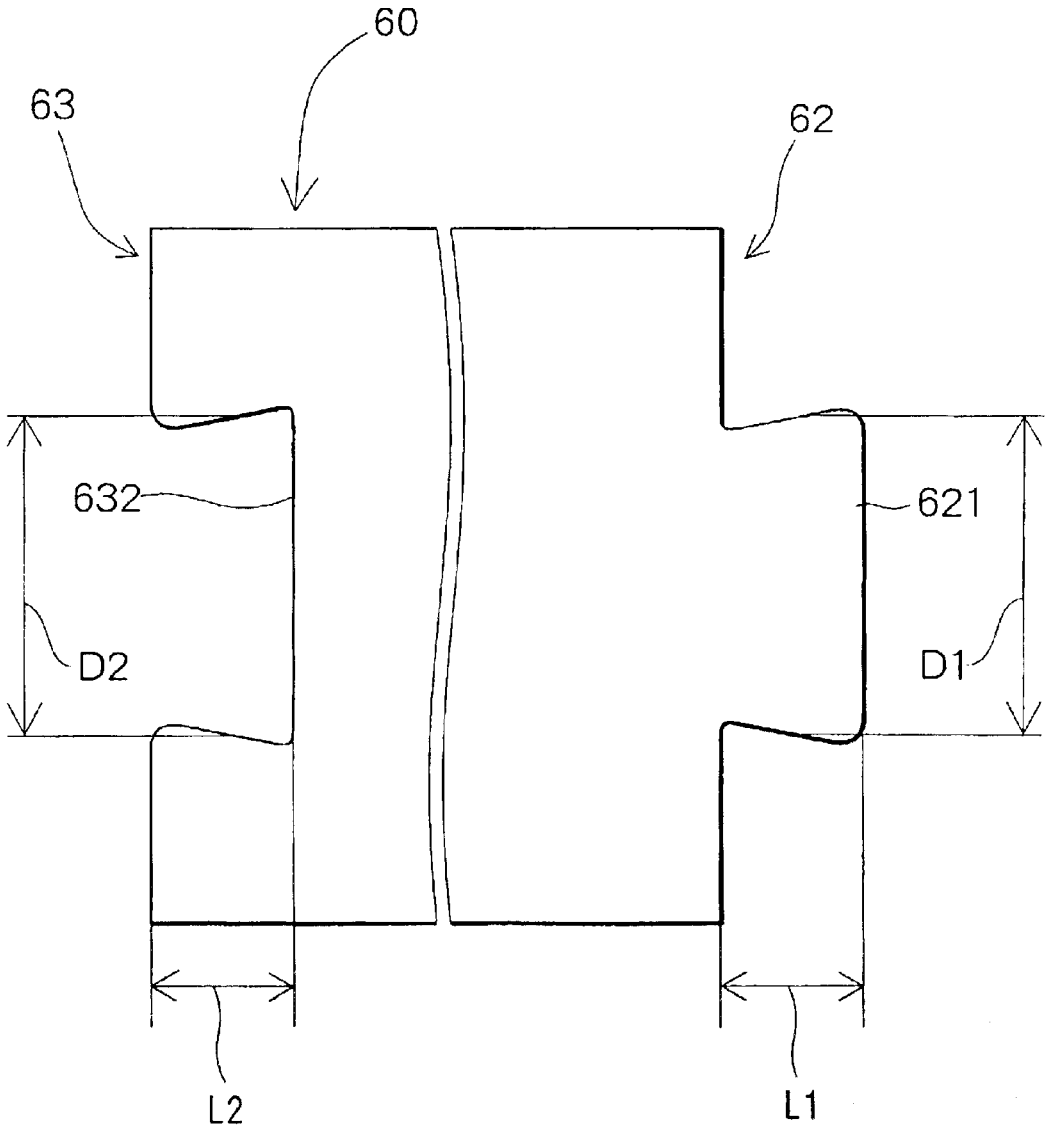
FIG. 3 is a schematic view of the lifter guide unfolded circumferentially by cutting off a seam according to the first embodiment.

As shown in FIG. 2, the lifter guide 60 is formed in shape of a cylinder whose circumferential wall is provided with a seam 61 bridging a gap extending from an axial end to another axial end thereof. If the lifter guide 60 is unfolded circumferentially by cutting off the seam 61 and, an unfolded circumferential end 62 is provided with a projection 621 having an axial width D1 and a circumferential height L1 and an unfolded another circumferential end 63 is provided with a recess 632 having an axial width D2 and a circumferential depth L2, as shown in FIG. 3. The axial width D1 of the projection 621 is gradually longer toward the top of the projection 621 and the axial width D2 of the recess 632 is gradually longer toward the bottom of the recess 632. Shape of the projection 621 generally corresponds to that of the recess 632 so that the axial width D1 is substantially equal to the axial width D2 at any circumferential position and the circumferential height L1 is substantially equal to the circumferential depth L2.

Figure 4:
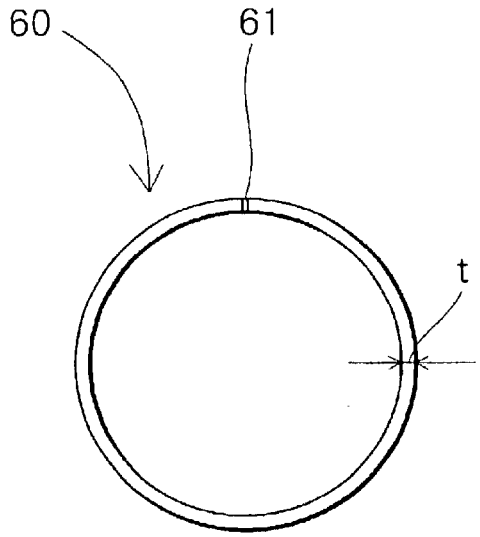
FIG. 4 is a perspective view of the lifter guide as viewed from an arrow IV in FIG. 2.

As shown in FIG. 4, wall thickness (radial thickness) t of the lifter guide 60 falls within a range of $0.5\ \text{mm} \leqq t \leqq 2.0\ \text{mm}$. It is preferable that the wall thickness of the lifter guide 60 is as thin as possible in view of achieving a compact body of the high pressure supply pump. However, the lifter guide 60 needs strength sufficiently enough to guide the lifter 50 sliding on the interior wall thereof. Accordingly, a lower limit of the wall thickness t of the lifter guide 60 is defined to 0.5 mm. On the other hand, an upper limit of the wall thickness t is defined to 2.0 mm, since it is very difficult to form the lifter guide 60 in a cylindrical shape from a flat plate to be described later.

The lifter guide 60 is installed between the attachment member 36 and the spring seat 42 in a state that the seam 61 is positioned with a given angular phase to the housing main body 32. A continuous smooth surface on the interior wall of the lifter guide 60 tends to discontinue at the seam 36 where the circumferential ends 62 and 63 are connected with each other. Accordingly, if the lifter 50 sliding on the interior wall of the lifter guide 60 contacts the seam 36, frictional wear of the lifter 50 or the lifter guide 60 becomes large.

Figure 5:
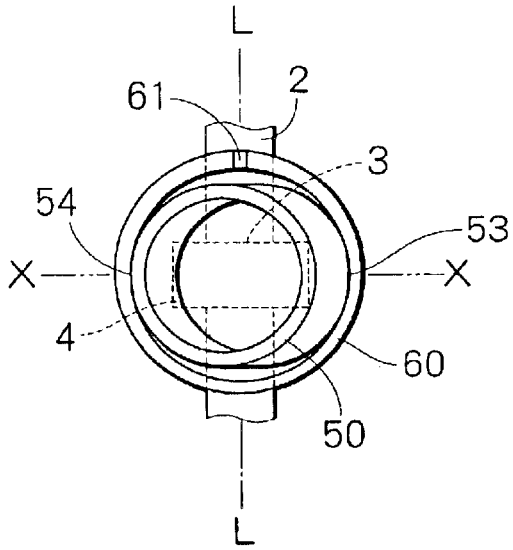
FIG. 5 is a schematic view showing positional relationship among a valve camshaft, a drive cam, a lifter and the lifter guide as viewed from a side of a pressure chamber according to the first embodiment.
Figure 6:
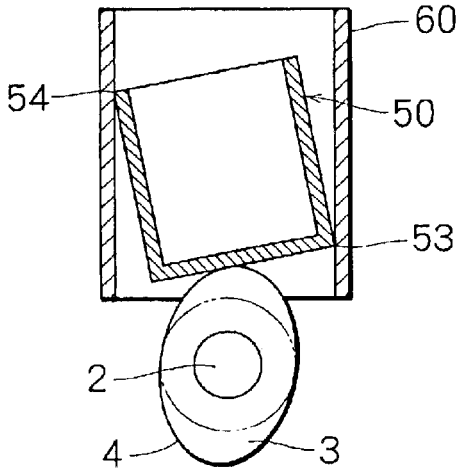
FIG. 6 is a cross sectional view taken along a center line X—X of a cam face of the drive cam in FIG. 5.

On the other hand, as shown in FIG. 5, a center line X—X of a cam surface 4 of the drive cam 3 is perpendicular to an axis L—L of a valve camshaft 2. As the bottom outer wall 51 of the lifter 50 is always in contact with the cam face 4, the lifter 50 receives forces not only acting axially but also acting in a direction of the center line X—X when the valve camshaft 2 rotates. A small clearance is generally formed between an outer circumferential surface of the lifter 50 and the interior surface of the lifter guide 60 for smoothly sliding the lifter 50 on the interior surface of the lifter guide 60. Accordingly, as shown in FIG. 6, an axis of the lifter 50 is inclined in the interior of the lifter guide 60 to the direction of the center line X—X from an axis of the lifter guide 60. As a result, an upper periphery point 53 of the lifter 50 and a lower periphery point 54 of the lifter 50, which are positioned on opposite sides of the axis of the lifter 50 in a direction of the center line X—X, come in contact with the interior wall of the lifter guide 60. The interior wall of the lifter guide 60 comes in contact with the upper and lower periphery points 53 and 54 along lines substantially parallel to the axis of the lifter guide 60 in a direction of the center line X—X, even if the lifter 50 moves axially and recirocatingly in the interior of the lifter guide 60 according to the rotation of the valve camshaft 2, since the lifter 50 does not substantially rotate relative to the lifter guide 60 according to the movement of drive cam 3. Accordingly, if the seam 61 is positioned on a diametrical line of the lifter guide 60 whose direction crosses the direction of the center line X—X, preferably, whose direction is nearly perpendicular to the direction of the center line X—X, the lifter 50 never contacts the seam 61.

A method of manufacturing the lifter guide 60 is described below.

Figure 7A:
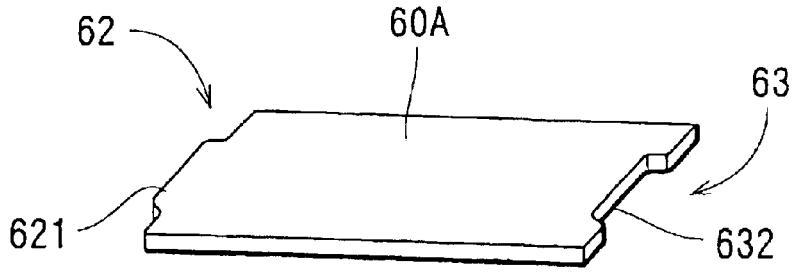
FIGS. 7A, 7B and 7C are schematic views showing a sequence of a method of manufacturing the lifter guide according to the first embodiment.

As shown in FIG. 7A, a flat plate 60A whose shape is substantially same as that of the lifter guide 60 unfolded circumferentially by cutting off the seam 61 is formed at first by stamping a general purpose steel sheet with a press machine. The flat plate 60A is provided at the circumferential end 62 with the projection 621 having the axial width D1 and the circumferential height L1 and at the other circumferential end 63 with the recess 632 having the axial width D2 and the circumferential depth L2. The axial width D1 is substantially equal to or slightly longer than the axial width D2 at any circumferential position and the circumferential height L1 is substantially equal to the circumferential depth L2. Thickness of the flat plate 60A is within a range of 0.5 mm≦=t≦2.0 mm.

Figure 7B:
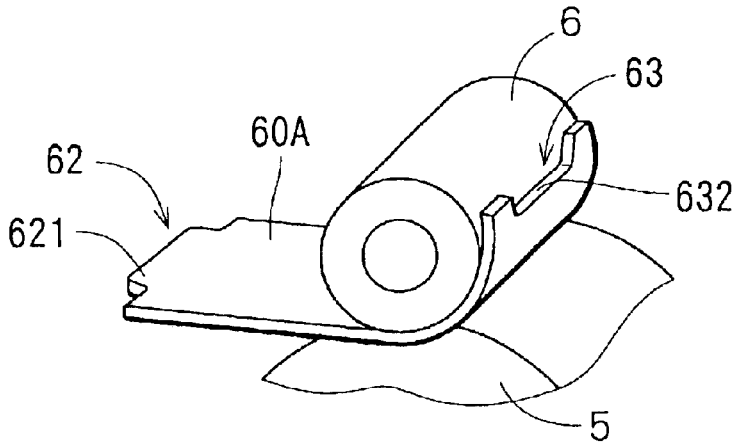

The flat plate 60A is formed in cylindrical shape by a process equipment having a large diameter roller 5 and a small diameter roller 6, as shown in FIG. 7B. The flat plate 60A is inserted into and passed through a gap between the large and small diameter rollers 5 and 6 so that the flat plate 60A is wound around the small diameter roller 6 and formed in cylindrical shape. The circumferential ends 62 and 63 abut on each other and, if the axial width D1 is substantially equal to the axial width D2, the projection 621 is fitted to the recess 632 while the flat plate 60A passes through the gap between the large and small diameter rollers 5 and 6. On the other hand, if the axial width D1 is slightly longer than the axial width D2 at any circumferential position, the projection 621 is press fitted to the recess 632. Diameter of the small diameter roller 6 is substantially equal to that of the outer circumference of the lifter 50. Accordingly, accuracy of inner diameter of the lifter guide 60 formed in cylindrical shape can be easily secured since the flat plate 60A is wound around the small diameter roller 6. Further, since the thickness of the flat plate 60A is within a range of 0.5 mm≦t≦2.0 mm, the flat plate 60A is easily wound around the small diameter roller 6 just by inserting the flat plate 60A into and passing them through the gap between the large and small diameter rollers 5 and 6.

Figure 7C:
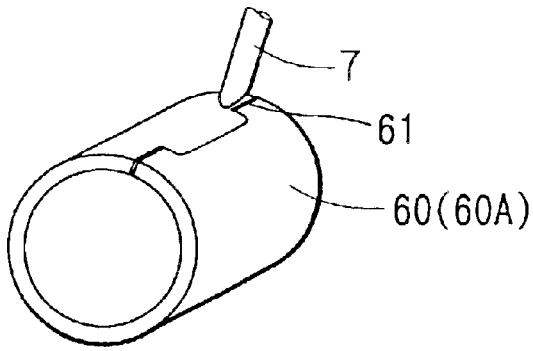

As shown in FIG. 7C, in the lifter guide 60 made of the flat plate 60A, it is preferable that boundary edges of the circumferential ends 62 and 63 abutted on each other are staked or plastically deformed by a tool 7. Only with fitting or press fitting connection between the projection 621 and the recess 632, the projection 621 is prone to come off the recess 632 when a shearing force is applied to one of the circumferential ends 62 and 63. Accordingly, staking by the tool 7 serves to reinforce fitting strength between the circumferential ends 62 and 63. Instead of or in addition to the staking by the tool 7, laser welding or gluing may be applied to more enhance the fitting strength.

Further, instead of winding the flat plate 60A around the small diameter roller 6 to an extent that the projection 621 is fitted or press fitted to the recess 632 in use of the large and small diameter rollers 5 and 6, the flat plate 60A may be formed primarily in shape of an incomplete (rough) cylinder. Then, in a state that a forming tool (not shown) is inserted into an interior of the incomplete cylinder, the incomplete cylinder is pressed inward from an exterior thereof so that the injection 621 is fitted or press fitted to the recess 632. Diameter of the forming tool is substantially equal to that of the outer circumference of the lifter 50. This process serves to secure higher shape accuracy of the inner diameter of the lifter guide 60.

According to the first embodiment mentioned above, since the lifter guide 60 is made of the flat plate 60A, the wall thickness of the lifter guide 60 is thinner than that of the conventional lifter guide formed by forging and machining. Further, the lifter guide 60 is easily fabricated through relatively simple processes in which the metal sheet is stamped to form the flat plate 60A and, after the flat plate 60 is cylindrically rounded, the abutting ends are staked. Furthermore, the discharge amount and the discharge pressure of the high pressure supply pump 1 are larger, compared to those of the conventional high pressure supply pump whose body size is equal to that of the high pressure supply pump 1. In other words, body size of the high pressure supply pump 1 is more compact, compared to that of the conventional high pressure pump whose discharge amount and discharge pressure are equal to those of the high pressure supply pump 1.

Moreover, since the wall thickness t of the lifter guide 60 is not smaller than 0.5 mm but not larger than 2.0 mm, the lifter guide 60 is made of the general purpose metal sheet whose material cost is relatively cheap so that the high pressure supply pump 1 can be achieved at less manufacturing cost.

Still further, since the seam 61 of the lifter guide 60 is positioned on a diametrical line of the lifter guide 60 whose direction crosses the direction of the center line X—X of the cam face 4, the lifter 50 never contacts the seam 61 so that life times of the lifter 50 and the lifter guide 60 are longer due to less frictional wear therebetween.

(Second Embodiment)

Figure 8:
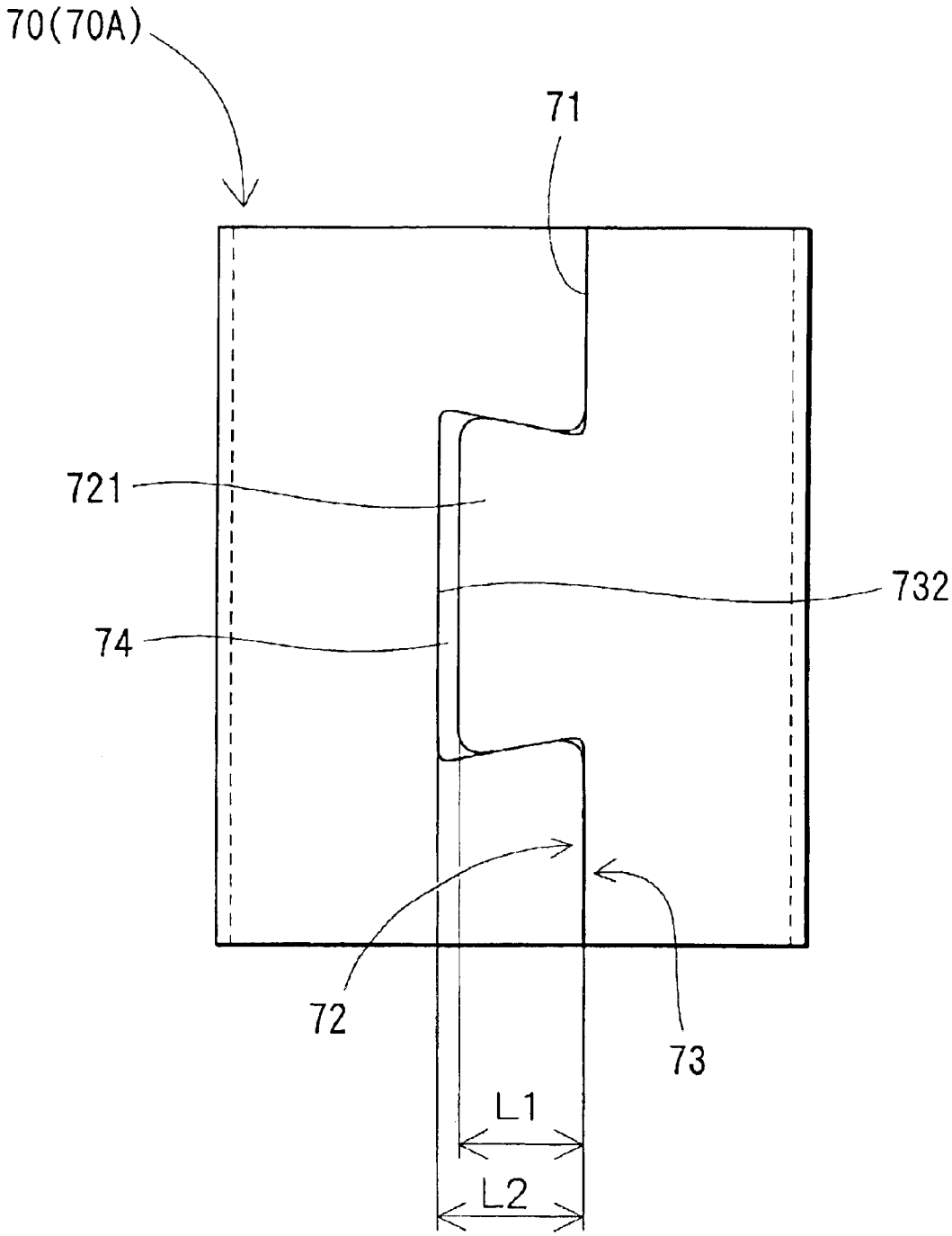
FIG. 8 is a schematic elevation view of a lifter guide according to a second embodiment of the present invention.

A lifter guide 70 of the high pressure supply pump according to a second embodiment is described with reference to FIG. 8.

The lifter guide 70 is formed in shape of a cylinder whose circumferential wall is provided with a seam 71. If the lifter guide 70 is unfolded circumferentially by cutting off the seam 71 and, an unfolded circumferential end 72, that is, a circumferential end 72 of the flat plate 70A, is provided with a projection 721 and an unfolded another circumferential end 73, that is, another circumferential end 73 of the flat plate 70A, is provided with a recess 732. Circumferential height L1 of the projection 721 is longer than circumferential depth L2 of the recess 732 so that, when the flat plate 70A is cylindrically rounded and the projection 721 is fitted or press fitted to the recess 732 to form the lifter guide 70, an opening 74 is formed between a bottom of the recess 732 and a top of the projection 721.

As shown in FIG. 1, when the lifter 50 moves recirocatingly in the interior of the lifter guide 60, a volume of space formed between the lifter guide 60 and the housing main body 32 is changed. When the lifter 50 moves toward the housing main body 32, air, fuel or oil existing in the space between the lifter guide 60 and the housing main body 32 is compressed so that the lifter 50 receives force acting toward the drive cam 3. On the other hand, when the lifter 50 moves in an opposite direction to the housing main body 32, the lifter 50 receives force acting toward the housing main body 32 due to volume expansion of the gap between the lifter guide 60 and the housing main body 32 in which the air, fuel or oil is accommodated. These forces give the lifter 50 a resistance on driving that causes a loss of an output of the engine to be transmitted via the valve camshaft 2 to the lifter 50.

To reduce the resistance on driving the lifter 50, the lifter guide 70 according to the second embodiment has the opening 64. When the lifter 50 moves toward the housing main body 32, the air, fuel or oil in an interior of the lifter guide 70 is easily ejected without being compressed to an exterior of the lifter guide 70 through the opening 74. On the other hand, when the lifter 50 moves in an opposite direction to the housing main body 32, new air, fuel or oil is easily sucked to the interior of the lifter guide 70 via the opening 74 from the exterior of the lifter guide 70.

Since the projection 721 and the recess 732 are formed just by stamping the metal sheet and the opening 74 is easily formed by cylindrically rounding the flat plate 70A and fitting or press fitting the projection 721 to the recess 732, an additional fabrication process such as drilling for forming the opening 74 is not necessary, which serves to reduce fabrication cost.

(Third Embodiment)

Figure 9:
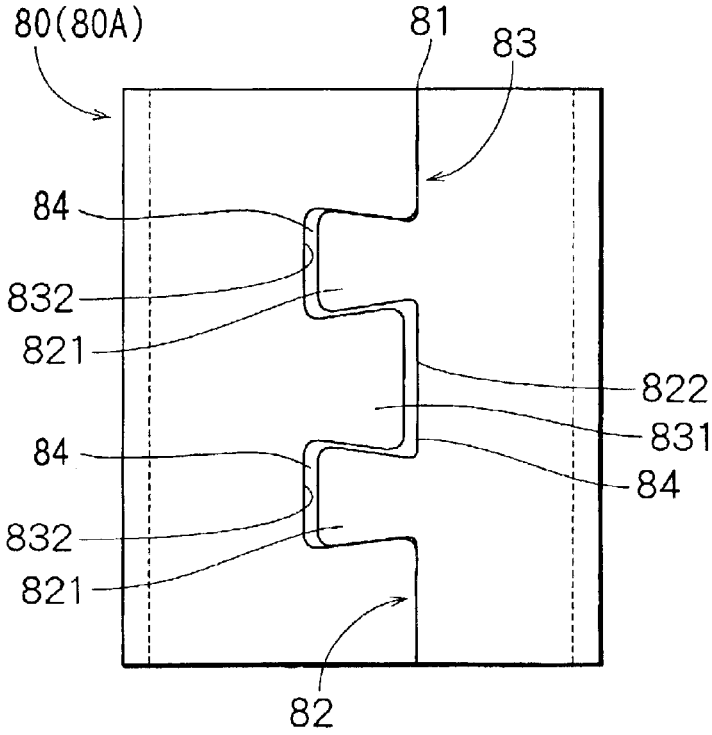
FIG. 9 is a schematic elevation view of a lifter guide according to a third embodiment of the present invention.

A lifter guide 80 of the high pressure supply pump according to a third embodiment is described with reference to FIG. 9.

The lifter guide 80 is formed in shape of a cylinder whose circumferential wall is provided with a seam 81. If the lifter guide 80 is unfolded circumferentially by cutting off the seam 81, an unfolded circumferential end 82, that is, a circumferential end 82 of a flat plate 80A, is provided with two projections 821 and a dale (recess) 822 positioned between the projections 821. An unfolded another circumferential end 83, that is, another circumferential end 83 of the flat plate 80A, is provided with two recesses 832 and a hill (projection) 831 positioned between the recesses 832. When the flat plate 80A is cylindrically rounded and each of the projections 821 is fitted or press fitted to each of the recesses 832 to form the lifter guide 80, a plurality of openings 84 are formed between a bottom of the respective recesses 732 and a top of the respective projections 821 and between a top of the hill 831 and a bottom of the dale 822.

According to the third embodiment, plurality of pairs of the projections 821, 831 and the recesses 832, 822 are provided. However, number of the pairs of the projections 821, 831 and the recesses 832, 822 may be any number. If the number of the pairs of the projections 821 and the recesses 832 is larger, strength of the seam 81 is more enhanced since shape of the seam 81 is more complicated. The number of the pairs of the projections 821, 831 and the recesses 832, 822 can be defined to meet a performance of the high pressure supply pump 1 in which the lifter guide 80 is applied. Further, since the projections 821, the dale 822, the recesses 832 and the hill 831 are formed just by stamping the metal sheet and the openings 84 are easily formed by cylindrically rounding the flat plate 80A and fitting or press fitting the projections 821 to the recesses 832, an additional fabrication process for forming the openings 84 is not necessary, which serves to reduce fabrication cost.

(Fourth Embodiment)

A modification of the lifter guide 90 of the high pressure supply pump according to the third embodiment is described with reference to FIGS. 10 and 11 as a fourth embodiment.

Figure 10:
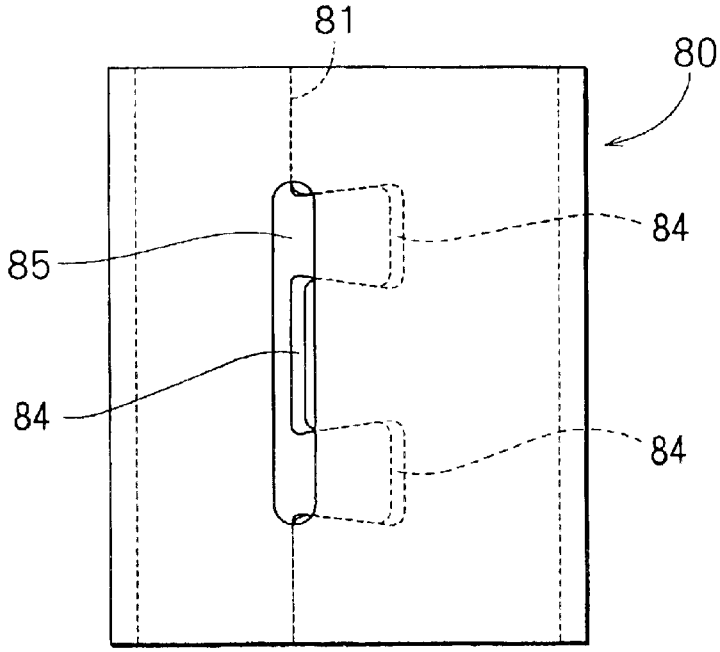
FIG. 10 is a schematic elevation view of a lifter guide according to a fourth embodiment of the present invention.
Figure 11:
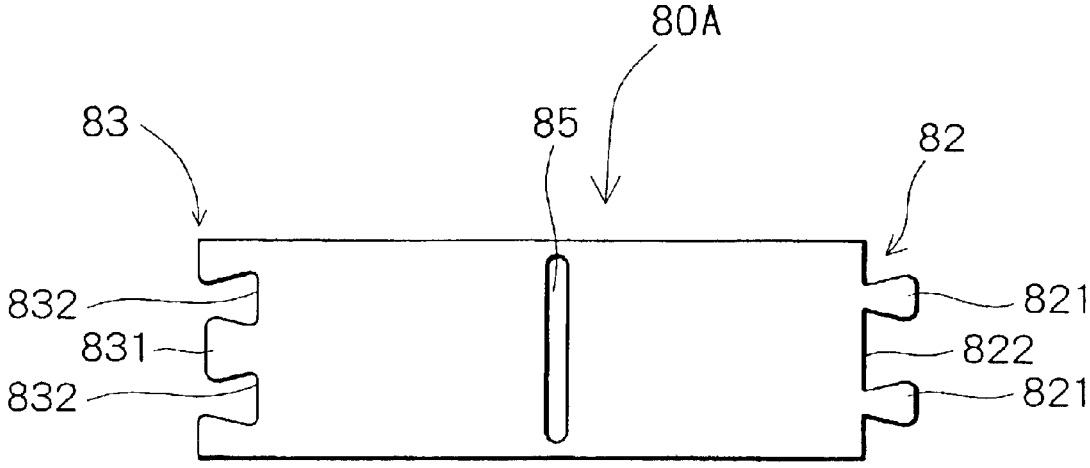
FIG. 11 is a schematic view of the lifter guide unfolded circumferentially by cutting off a seam according to the fourth embodiment.

The lifter guide 80 is further provided at the circumferential wall thereof on a side roughly radially opposite to the seam 81 with another opening 85, as shown in FIG. 10. The opening 85 is an axially elongated hole. When the flat plate 80A is stamped with the press equipment from the metal sheet, the another opening 85 is formed together with the projections 821, the dale 822, the recesses 832 and the hill 831, as shown in FIG. 11. The opening 85 is at a circumferentially roughly middle position between circumferential ends 82 and 83, but may be at any position circumferentially intermediate between the circumferential ends 82 and 83, unless the opening 85 is positioned in a direction in which the lifter 50 is inclined in an interior of the lifter guide 80.

Air, fuel or oil can flow not only through the openings 84 but also through the opening 85, when the lifter 50 moves reciprocatingly in the interior of the lifter guide 80. Accordingly, in a case of a high speed and high revolution engine in which the lifter 50 moves at high speed, the air, fuel or oil can be smoothly sucked and ejected through the openings 84 and 85.

Since the opening 85 is formed in the flat plate 80A at a time when the flat plate 80A is stamped from the metal sheet, an additional fabrication process such as machining for forming the opening 85 is not necessary, which serves to reduce fabrication time and manufacturing cost.

In the embodiments mentioned above, the high pressure supply pump is applied to the diesel engine. However, the high pressure supply pump may be applied to a gasoline engine.

Further, the processes of stamping the metal sheet to form the flat plate and rounding the flat plate can be executed by a forming method such as a multi-forming or sequential feed pressing. However, these processes may be executed by any other forming method.

Furthermore, the seaming process of staking, welding or gluing may be omitted or may be any other connecting process, since the seaming process is employed for reinforcing fitting or press fitting strength between the projection and recess.

What is claimed is:

1. A high pressure supply pump comprising:

a housing having a cylinder;

a plunger slidably and recirocatingly movable in the cylinder, an axial end of the plunger and the cylinder forming a pressure chamber;

a lifter having a cylindrical wall with a bottom whose inner surface faces the other axial end of the plunger;

a drive cam arranged on an opposite side of the plunger with respect to the lifter and in contact with an outer surface of the bottom of the lifter, a drive force of the drive cam being transmitted via the lifter to the plunger; and a cylindrical lifter guide positioned around a circumferential wall of the lifter and fixed to the housing concentrically with the plunger so as to guide the lifter to move reciprocatingly therein, wherein a circumferential wall of the lifter guide has a seam bridging at least a part of a gap extending from an axial end to the other axial end thereto.

2. A high pressure supply pump according to claim 1, wherein the gap is not entirely seamed so that a part of the gap constitutes an opening.

3. A high pressure supply pump according to claim 2, wherein the circumferential wall of the lifter guide has another opening circumferentially apart from the opening.

4. A high pressure supply pump according to claim 3, wherein the another opening is at a position generally diametrically opposite to the opening.

5. A high pressure supply pump according to claim 1, wherein, the lifter guide unfolded circumferentially by cutting off the seam is provided at a circumferential end thereof with a projection and at another circumferential end thereof with a recess to be fitted to the projection.

6. A high pressure supply pump according to claim 5, wherein a circumferential height of the projection is shorter than a circumferential depth of the recess so that an opening is formed between a top of the projection and a bottom of the recess when the projection is fitted to the recess.

7. A high pressure supply pump according to claim 5, wherein an axial width of the projection is gradually longer toward a top of the projection and an axial width of the recess is gradually longer toward a bottom of the recess.

8. A high pressure supply pump according to claim 1, wherein thickness of the circumferential wall of the lifter guide is not thinner than 0.5 mm but not thicker than 2.0 mm.

9. A high pressure supply pump according to claim 1, wherein the seam and the gap are positioned on a diametrical line of the lifter guide whose direction crosses a cam surface center line of the drive cam at a given angle thereto.

10. A high pressure supply pump according to claim 9, wherein the seam and the gap are on a line generally perpendicular to the cam surface center line of the drive cam.

11. A method of manufacturing a lifter guide of a high pressure supply pump, wherein a drive force of a drive cam is transmitted via a lifter to a plunger slidably and reciprocatingly movable in a cylinder of a housing and the lifter guide is positioned around a circumferential wall of the lifter and fixed to the housing concentrically with the plunger so as to guide the lifter to move reciprocatingly therein, comprising steps of:

forming a flat plate whose periphery line is provided with a projection and whose another periphery line circumferentially opposed to the periphery line is provided with a recess;

rounding the flat plate circumferentially so as to cause the periphery line to abut on the another periphery line so that the flat plate is formed in generally cylindrical shape and the projection is fitted to the recess; and seaming at least partly the periphery line with the another periphery line to reinforce fitting between the projection and the recess.

12. A method of manufacturing a lifter guide according to claim 11, further comprising steps of:

adjusting inner diameter of the flat plate formed in cylindrical shape to predetermined shape and dimension when the flat plate is rounded.

13. A method of manufacturing a lifter guide according to claim 11, wherein an axial width of the projection is slightly longer than an axial width of the recess at a circumferential position so that the projection is press fitted to the recess.

14. A method of manufacturing a lifter guide according to claim 11, wherein a circumferential height of the projection is shorter than a circumferential depth of the recess so that an opening is formed between a top of the projection and a bottom of the recess when the projection is fitted to the recess.

* * * * *